US007048132B2

(12) United States Patent
Yamanaka et al.

(10) Patent No.: US 7,048,132 B2
(45) Date of Patent: May 23, 2006

(54) SYNTHETIC RESIN BOTTLE

(75) Inventors: Nobuo Yamanaka, Koto-ku (JP); Yoshio Akiyama, Tochigi (JP); Shinji Shimada, Koto-ku (JP); Takao Kurosawa, Koto-ku (JP); Shigeru Hayakawa, Koto-ku (JP); Koji Sasagawa, Tochigi (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 37 days.

(21) Appl. No.: 10/451,948

(22) PCT Filed: Aug. 28, 2002

(86) PCT No.: PCT/JP02/08669

§ 371 (c)(1),
(2), (4) Date: Aug. 5, 2003

(87) PCT Pub. No.: WO2004/020296

PCT Pub. Date: Mar. 11, 2004

(65) Prior Publication Data

US 2005/0072752 A1 Apr. 7, 2005

(51) Int. Cl.

| | |
|---|---|
| ***B65D 1/02*** | (2006.01) |
| ***B65D 1/32*** | (2006.01) |
| ***B65D 23/02*** | (2006.01) |
| ***B65D 23/08*** | (2006.01) |

(52) U.S. Cl. ..... 215/381; 215/900; 220/666; 220/907

(58) Field of Classification Search ..... 215/379–384, 215/900; 220/666, 671, 907; 222/107, 212
See application file for complete search history.

(56) References Cited

U.S. PATENT DOCUMENTS

| | | | | | |
|---|---|---|---|---|---|
| 2,950,029 | A | * | 8/1960 | Winstead | 222/143 |
| 3,524,488 | A | * | 8/1970 | Scholle | 220/604 |
| 3,603,366 | A | * | 9/1971 | Albizati et al. | 604/317 |
| 3,626,939 | A | * | 12/1971 | Maltenfort et al. | 604/216 |
| 4,056,138 | A | * | 11/1977 | Fagniart | 383/120 |
| 4,559,053 | A | * | 12/1985 | Porges | 604/408 |
| 5,122,399 | A | * | 6/1992 | Farrell et al. | 428/34.2 |
| 5,224,613 | A | * | 7/1993 | Robbins, III | 215/10 |
| 5,575,398 | A | * | 11/1996 | Robbins, III | 220/8 |
| 5,860,556 | A | * | 1/1999 | Robbins, III | 220/666 |

FOREIGN PATENT DOCUMENTS

| | | | |
|---|---|---|---|
| DE | 3530014 | A1 * | 2/1987 |
| JP | A 63-99815 | | 5/1988 |
| JP | 04057751 | A * | 2/1992 |
| JP | A 11-130033 | | 5/1999 |

(Continued)

*Primary Examiner*—Sue A. Weaver
(74) *Attorney, Agent, or Firm*—Oliff & Berridge, PLC

(57) ABSTRACT

A blow-molded synthetic resin bottle that can be fully flattened and easily restored to an original shape. The bottle includes at least a line of turn is formed on the shoulder, the body, and the bottom along the entire vertical circumference. Among the sections divided by this line of turn, at least a section is used as a shell section in which at least a nearly entire body portion of this section has relatively high rigidity. The other section is a reversible section in which at least a nearly entire body portion has relatively low rigidity and is capable of being deformed by resilient reversion. The neck is disposed on the shoulder, and the reversible section can be deformed and easily concaved into the shell section for volume reduction and then can be restored to the original shape.

7 Claims, 11 Drawing Sheets

FOREIGN PATENT DOCUMENTS

| | | |
|---|---|---|
| JP | A 2001-48148 | 2/2001 |
| JP | A 2002-104355 | 4/2002 |
| JP | A 2002-104356 | 4/2002 |
| JP | A 2002-104357 | 4/2002 |
| JP | A 2002-166917 | 6/2002 |
| JP | A 2002-255144 | 9/2002 |

* cited by examiner

SYNTHETIC RESIN BOTTLE

TECHNICAL FIELD

This invention relates to a synthetic resin bottle of a configuration that the bottle can be deformed to reduce its volume easily and then is restored to its original shape for use as a bottle.

BACKGROUND OF THE INVENTION

Synthetic resin bottles are in wide use as the containers for various liquid contents. These bottles are molded by using blow molding or biaxial-drawing, blow-molding means.

This synthetic resin bottle has an advantage of light-weight. On the other hand, because of bulkiness and large space of occupancy, a problem of high storage and transportation costs are caused during the process in which bottles are molded by the bottle manufacturers, delivered to product manufacturers, and filled with liquids. Handling of bulky bottles is also troublesome.

After use, the used bottles are usually flattened with hands or feet to reduce the volume of the bottle and to facilitate waste disposal. The bottles had a problem in that everyone cannot always flatten bottles easily and steadily.

Utility model laid open No. 1985-75212 describes a technique aimed at easily flattening bottles at the time of waste disposal.

The synthetic resin bottle described in this utility model is provided with a pair of ribs at the axisymmetric positions on the body. In addition to these ribs, arc ribs are also provided on the shoulder and at the lower end of the body. When the bottle is put to waste disposal, the portion surrounded by the ribs is pressed to let the body cave in and deform so that volume reduction can be achieved.

However, in this conventional art, the concaved portion ranges from the shoulder to the lower end of the body, with neck and bottom retaining the original shapes. Because of this limitation, the bottle had trouble in that the entire bottle cannot be pressed flat and deformed. Since these ribs are aimed at flattening the bottle at the time of waste disposal, it was almost impossible to restore the original shape of the bottle once the bottle has been forced to cave in.

This invention has thus been made to solve the problems of the above-described conventional art. The technical problem of this invention is to deform the bottle easily in a volume-reducing manner until the bottle is fully flat and then to be able to restore the original shape as a bottle from the flat or concaved state. Thus, an object of this invention is to make bottle handling easy and efficient during the process from molding to the filling of bottles with contents and at the time of bottle disposal as waste, and the reduction of the cost.

DISCLOSURE OF THE INVENTION

Exemplary embodiments may include a blow-molded synthetic resin bottle including at least one line of turn formed on the shoulder, the body, and the bottom, formed along an entire vertical circumference of the bottle, and dividing the bottle into sections, the sections including: at least one shell section located on one side of the line of turn, the shell section including a substantially high rigidity; at least one reversible section located on another side of the line of turn, the reversible section including a substantially low rigidity such that the reversible section is deformable by resilient reversion; and a neck disposed only on a portion of the shoulder that is located on the one side of the line of turn in which the shell section is located, wherein the reversible section may be easily deformed from an original shape to a concave shape that may be received by the shell section and then restored back to the original shape by the resilient reversion.

Owing to the above configuration of the exemplary embodiments, the bottle molded by the bottle manufacturer is reversed from the line of turn by pressing the less rigid reversible section inward and concaving this section toward the inside of the shell section to reduce the volume of the bottle.

Commercial product manufacturers should be able to reverse the concaved reversible section again outward, by using air pressure and the like, to restore the original shape. The restored bottle can then be filled with a liquid content to complete a commercial product. Or the manufacturers can fill the concaved bottle directly with a liquid content. In that case, the liquid filling force acts on the concaved reversible section to turn the section outward. The liquid filling operation is continued until the bottle is full and ready for merchandising.

When the bottle is used and discarded as waste, the reversible section is again concaved to reduce the volume, and the flattened bottle is disposed of as waste.

Exemplary embodiments may include a line of turn formed at the position dividing the plan-view shapes of the shoulder, the body, and the bottom into two equal, right and left, parts; that the shell section includes a major-diameter portion, which is a half on one side of this line of turn, where the plan view of the body roughly forms an arc-like convex surface having a larger diameter; and that the reversible section includes a minor-diameter portion, which is the remaining half on the other side of this line of turn, where the plan view of the body roughly forms an arc-like convex surface having a smaller diameter.

Because of the above configuration of the exemplary embodiments, the reversible section protruding in an arc-like convex surface can be deformed inward and concaved into the inside of the shell section protruding likewise in an arc-like convex surface but having a larger diameter than the reversible section. Thus, it is possible to flatten the bottle in a certain shape. Since the flat bottles can be easily piled up, the bottles before use can be stored and transported, or the bottles after use can be handled for waste disposal, more efficiently and at a lower cost than the bottles retaining the original shape.

Exemplary embodiments may include the neck disposed so as to stand on the shoulder at the upper end of the shell section.

Because, in the above configuration of the exemplary embodiments, the neck disposed on the shell section side, the entire bottle can be flattened without crushing the neck. Therefore, it is possible to concave and deform easily the halves of the shoulder, the body, and the bottom, or almost a half of the bottle.

Exemplary embodiments may include the neck disposed to stand in the center of the shoulder and that a line of turn is formed at the position dividing the plan-view shapes of the shoulder, the body, and the bottom axisymmetrically into two equal, right and left, parts.

Because, in the above configuration of the exemplary embodiments, a shell section and a reversible section are formed also at the neck, the entire bottle can be fully flattened to reduce the volume, over all the height from neck to bottom.

Exemplary embodiments may include a pair of lines of turn formed at roughly symmetrical positions in the plan view of the shoulder, the body, and the bottom; that among the sections divided by these two lines of turn, the shell section is the central portion where side walls of the body face each other; and that the reversible sections are the two portions disposed on both sides of the shell section, with each reversible section having an arc-like convex surface protruding outward in the plan view of the body.

In the above configuration of the exemplary embodiments, the bottle can be deformed and concaved into the inside of the shell section located in the center, by pressing both reversible sections inward to reverse these section resiliently. As a result, both reversible sections are concaved and accommodated inside the shell section, where the plan-view shape of the entire body including the bottom roughly forms a rectangle. Thus, it becomes possible to flatten the bottle to an extent enough to reduce its volume.

The bottle according to the above exemplary embodiments excels at bottle handling because the bottle stands fully on its own due to the shell section in the center.

Exemplary embodiments may include the bottle being molded from a relatively soft synthetic resin so as to have a thin wall and that on at least either one of the inner surface or the outer surface of the shell section, the most part of at least the body surface is laminated with another layer.

In the above configuration of the exemplary embodiments, the laminated bottle wall is given higher rigidity than the non-laminated wall portion, where the bottle is molded to have a thin wall. Since there is no need to change the wall thickness of the bottle itself, the bottles can be easily manufactured by means of an ordinary blow molding method, while securing high productivity.

Exemplary embodiments may further include a relatively thick, hard label is laminated over the outer surface of the body.

In the above configuration of the exemplary embodiments, a label is laminated over the entire outer surface of at least the body portion in one section of the bottle divided by the line of turn. This label enables the shell section to be formed easily at a low cost. High decorative effect and high display effect can be obtained since it is possible for the label to have a wide display area.

In addition, the rigidity of the shell section is fully enhanced, and the bottle shows high shape-holding power. Because of these features, the bottle shape becomes stabilized and constant when the bottle is deformed for volume reduction and when it is restored to the original shape. The bottle can be allowed to have thin walls with no difficulty, by making the label serve as a structural material.

Exemplary embodiments may include the shell section of the bottle being molded so as to have an ordinary thick wall, with the reversible section being molded so as to have a relatively thin wall.

In the above configuration of the exemplary embodiments, the shell section and the reversible section can be formed simultaneously with the molding of the bottle. Depending on the parts of the bottle, the wall thickness ratio of the shell section to the reversible section is changed so that the rigidity of both sections may be adjusted finely and precisely. Thus, it becomes quite easy to reverse the reversible section of the entire bottle toward the shell section and in turn to restore the original bottle shape.

Exemplary embodiments may include the line of turn including a sloped step.

In the above configuration of the exemplary embodiments, the line of turn has a sloped step structure, which makes it easy to reverse and deform the reversible section and makes it much easier for the reversible section to be concaved and then restored to its original shape. Since the reversible section is deformed and reversed without causing permanent deformation, no outer appearance is damaged by reversible deformation.

Exemplary embodiments may include the line of turn including a shallow V-shape groove.

In the above configuration of the exemplary embodiments, the reversible section can be reversed quite easily and precisely.

DETAILED DESCRIPTION OF EMBODIMENTS

Figure 1:
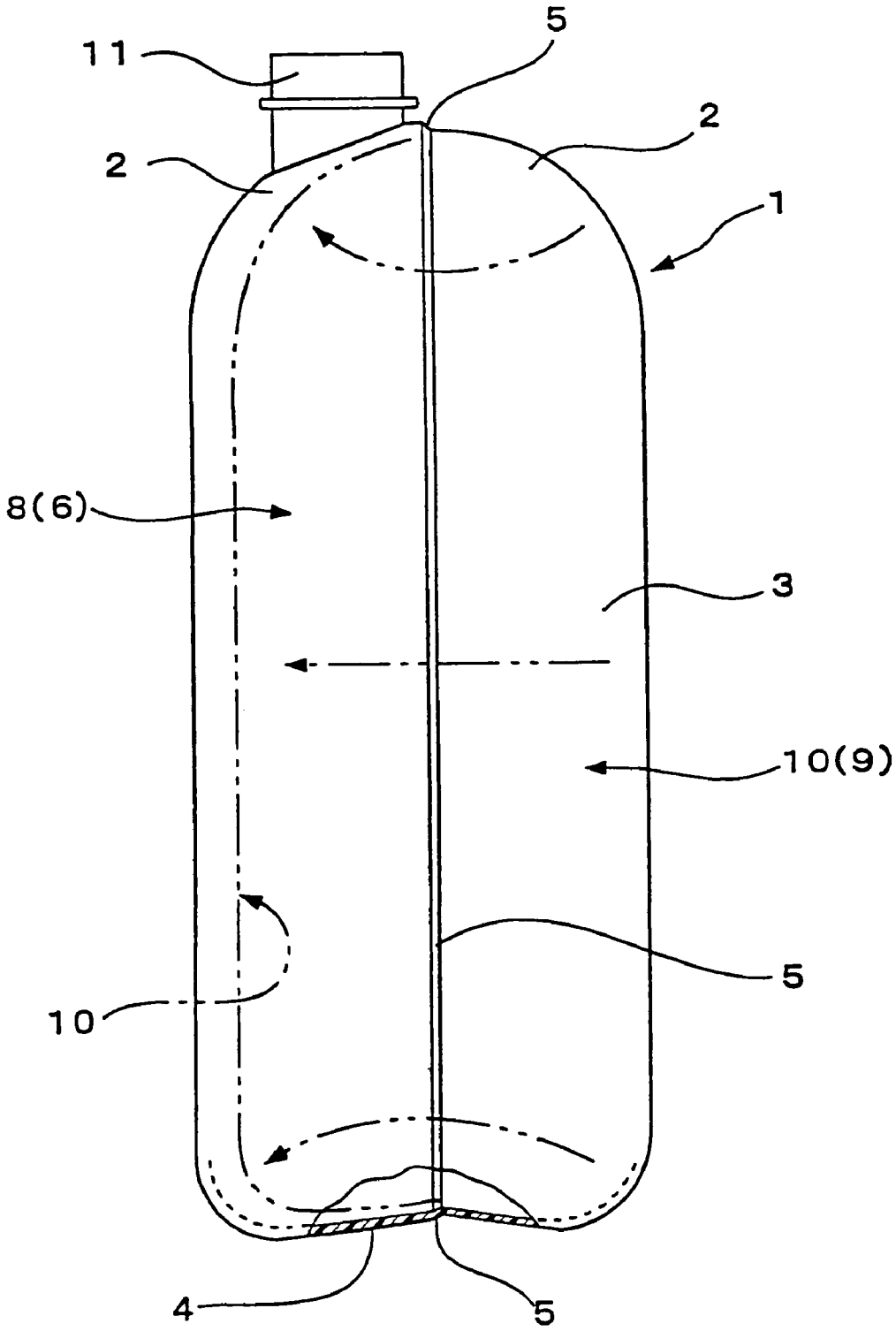
FIG. 1 is a partly cross-sectional side view showing a first exemplary embodiment.

This invention is further described as to its preferred embodiments, now referring to the drawings.

Figure 2:
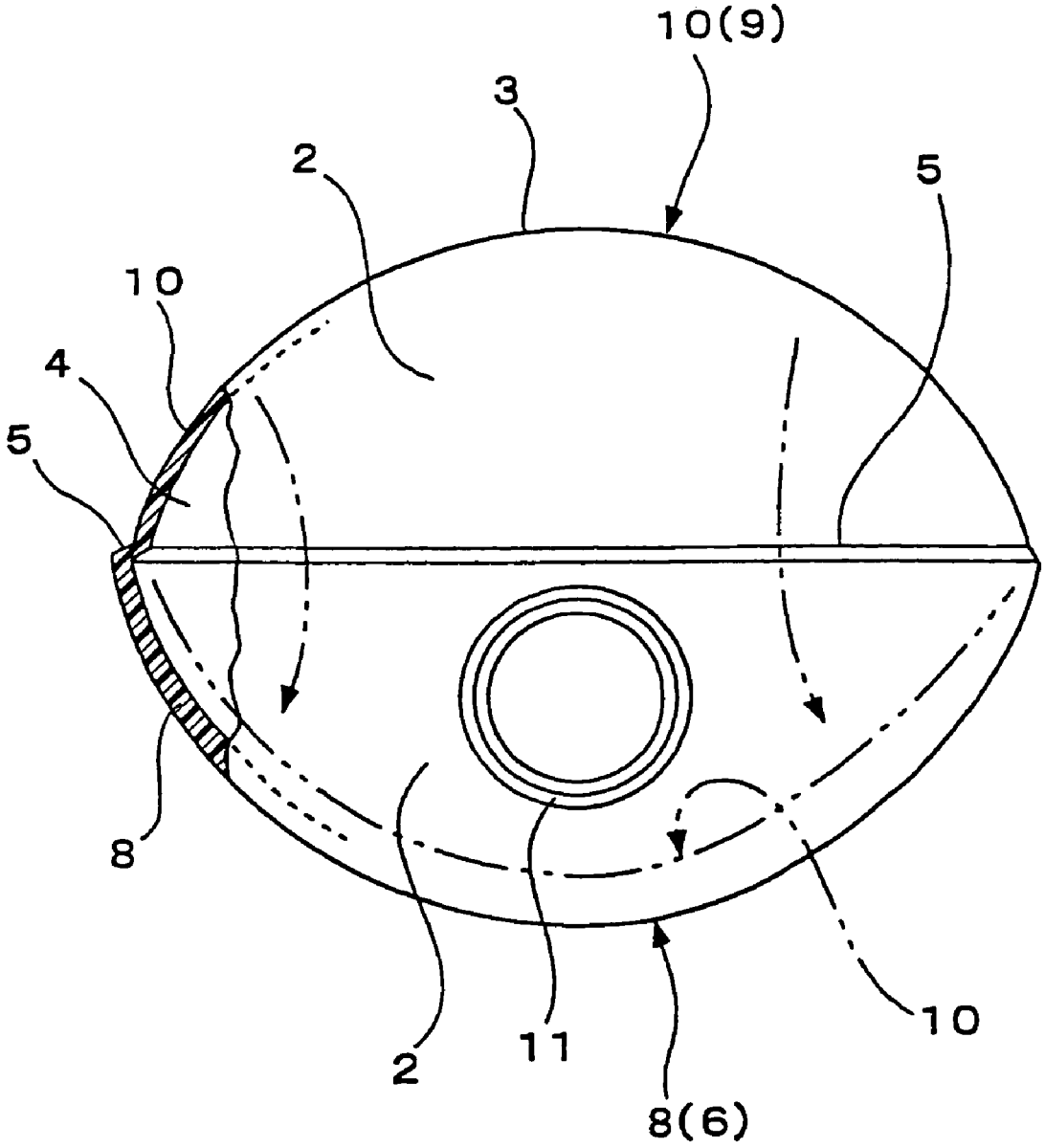
FIG. 2 is a partly cross-sectional plan view of the exemplary embodiment shown in FIG. 1.

FIGS. 1 and 2 show a blow-molded synthetic resin bottle in the first embodiment of this invention. The bottle 1 is formed by blow molding a suitable synthetic resin material so that the plan view of the bottle 1 has a roughly elliptic shape. A cylindrical neck 11 is disposed to stand on the shoulder 2 on one side of the long axis of the ellipse.

A line of turn 5 in the shape of a sloped step is disposed at the positions on the long axis, i.e., at the axisymmetrical positions of the bottle 1, around the entire circumference in the vertical direction of the bottle 1, including the shoulder 2, the body 3, and the bottom 4.

A major-diameter portion 6 occupies a half of the bottle 1 as divided by this line of turn 5 (the left side in FIG. 1). This portion is molded to have an ordinary thick wall and is used as the shell section 8, which has relatively high rigidity and is easy to grab.

The minor-diameter portion 9 occupies the other half of the bottle 1 as divided by the line of turn 5 (the right side in FIG. 1). This portion 9 has a somewhat smaller diameter and a thinner wall thickness than the major-diameter portion 6 and is used as the reversible section 10, which can be deformed in a resiliently reversible manner.

Therefore, this reversible section 10 is resiliently reversed simply by pressing it inward, with the line of turn 5 serving as the fulcrum. The reversible section 10 is entirely concaved into the inside of the shell section 8, as shown by a chain double-dashed line in FIGS. 1 and 2, and can be easily restored to its original shape by applying a force in the opposite direction and reversing this section outward.

Because of relatively high rigidity, the shell section 8 has also a good buckling strength and the hardness enough to be able to grab the bottle. Therefore, the bottle can be held and handled in the same way as ordinary bottles. The bottle of this invention has no disadvantage of conventional volume-reducing bottles, which are too soft to hold the bottle firmly with a hand.

It is preferred that the reversible section 10 has a wall thickness ⅔ or less of the shell section 8.

Figure 3:
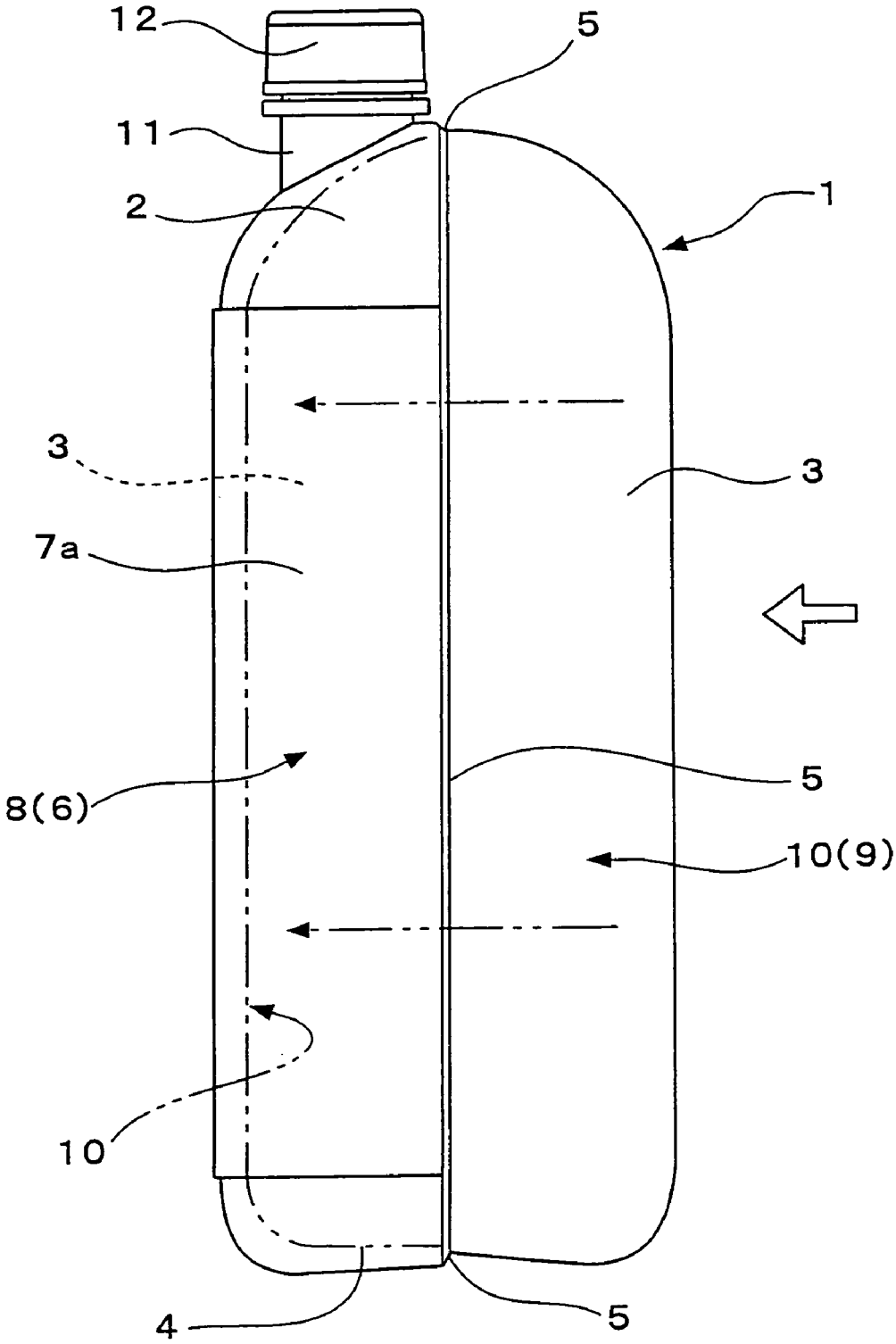
FIG. 3 is a side view showing a second exemplary embodiment.
Figure 4:
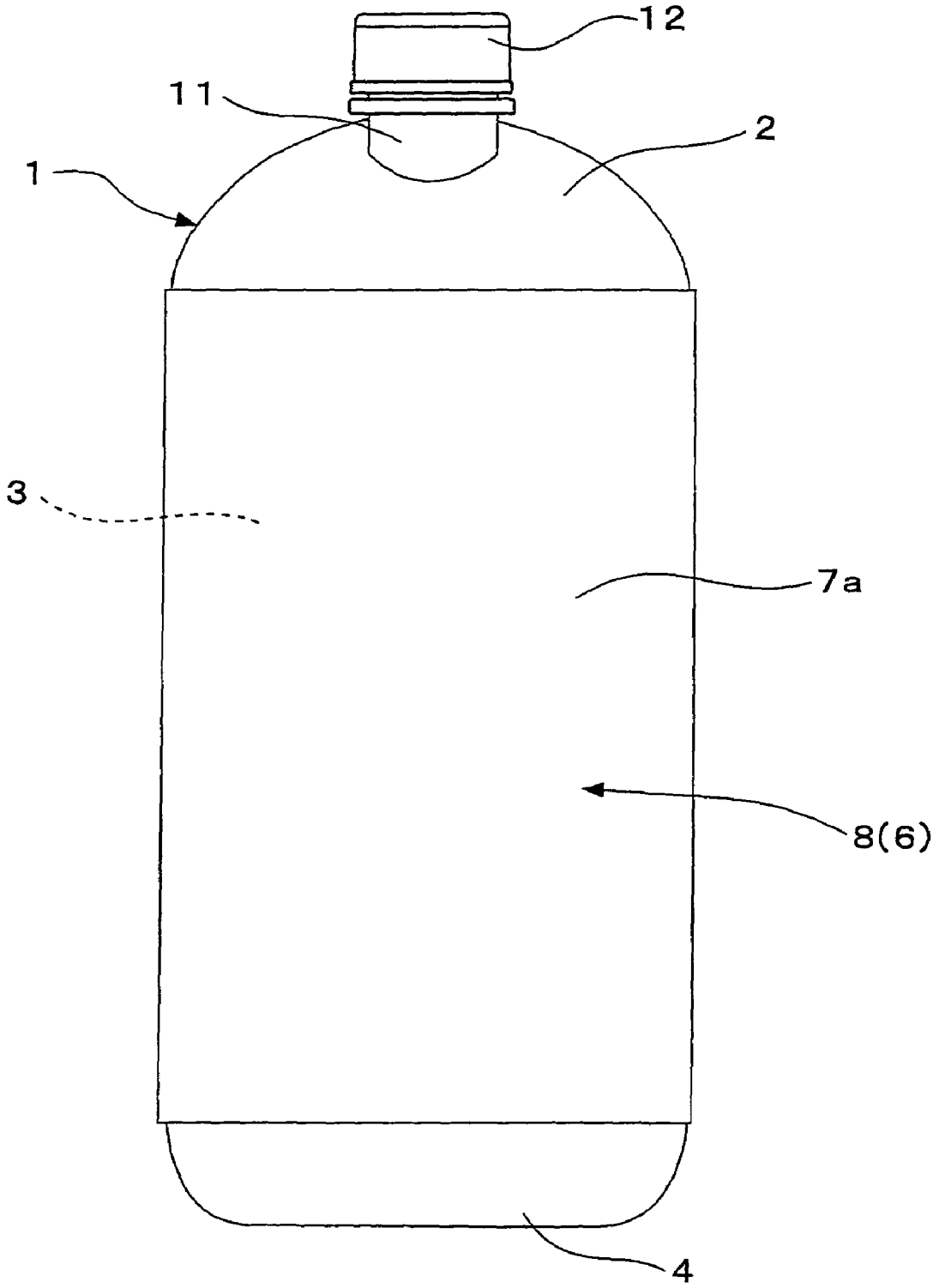
FIG. 4 is a front elevational view of the exemplary embodiment shown in FIG. 3.
Figure 5:
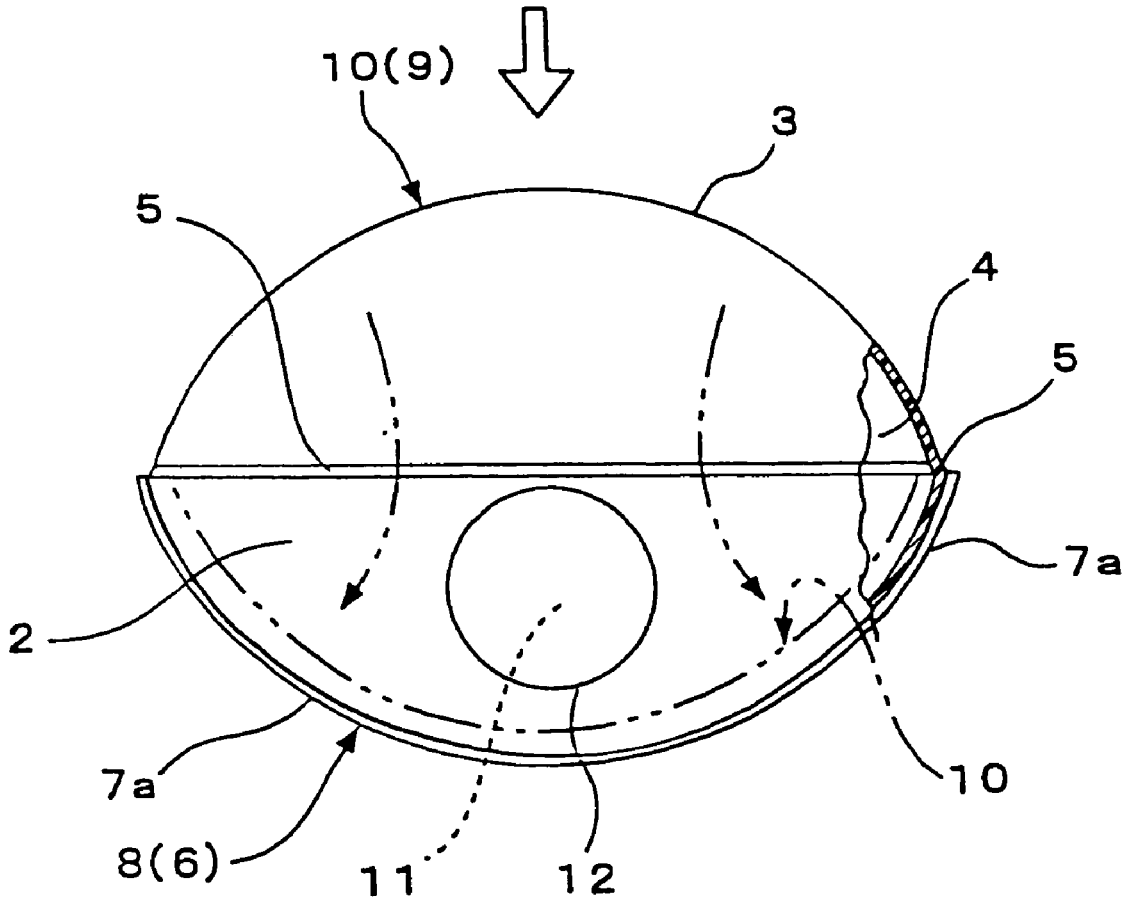
FIG. 5 is a partly cross-sectional plan view of the exemplary embodiment shown in FIG. 3.

FIGS. 3–5 show a synthetic resin bottle in the second embodiment of this invention. The overall shape of the bottle 1, the shape and position of the line of turn 5, and the like, are similar to those of the bottle in the first embodiment. FIGS. 3–5 show a cap 12 that has been fitted detachably around neck 11.

The bottle 1 is molded by blow molding a suitable, relatively soft synthetic resin to give a thin wall thickness on the whole and to have a roughly elliptic shape in its entire plan view.

A hard, relatively thick label 7*a* of a paper material is attached to nearly all the outer surface of the body 3 in the major-diameter portion 6 by means of insert molding or lamination. This major-diameter portion 6 is used as the shell section 8 having relatively high rigidity; the thin minor-diameter portion 9 is used as the reversible section 10.

This reversible section 10 is resiliently reversed simply by pressing it inward, with the line of turn 5 serving as the fulcrum. The reversible section 10 is entirely concaved into the inside of the shell section 8, as shown by a chain double-dashed line in FIGS. 3 and 5, and can be easily restored to its original shape by applying a force in the opposite direction and reversing this section outward.

Because of relatively high rigidity, the shell section 8 has also a good buckling strength and the hardness enough to be able to grab the bottle. Therefore, the bottle can be held and handled in the same way as ordinary bottles. The bottle of this invention has no disadvantage of conventional volume-reducing bottles, which are too soft to hold the bottle firmly with a hand.

If a thick, hard paper material is used as the label 7*a*, the bottle 1 is able to maintain its own shape stably, and further thin wall can be promoted for the bottle 1. Depending on how much wall thickness can be reduced, easy bottle handling can be achieved for waste disposal.

Figure 6:
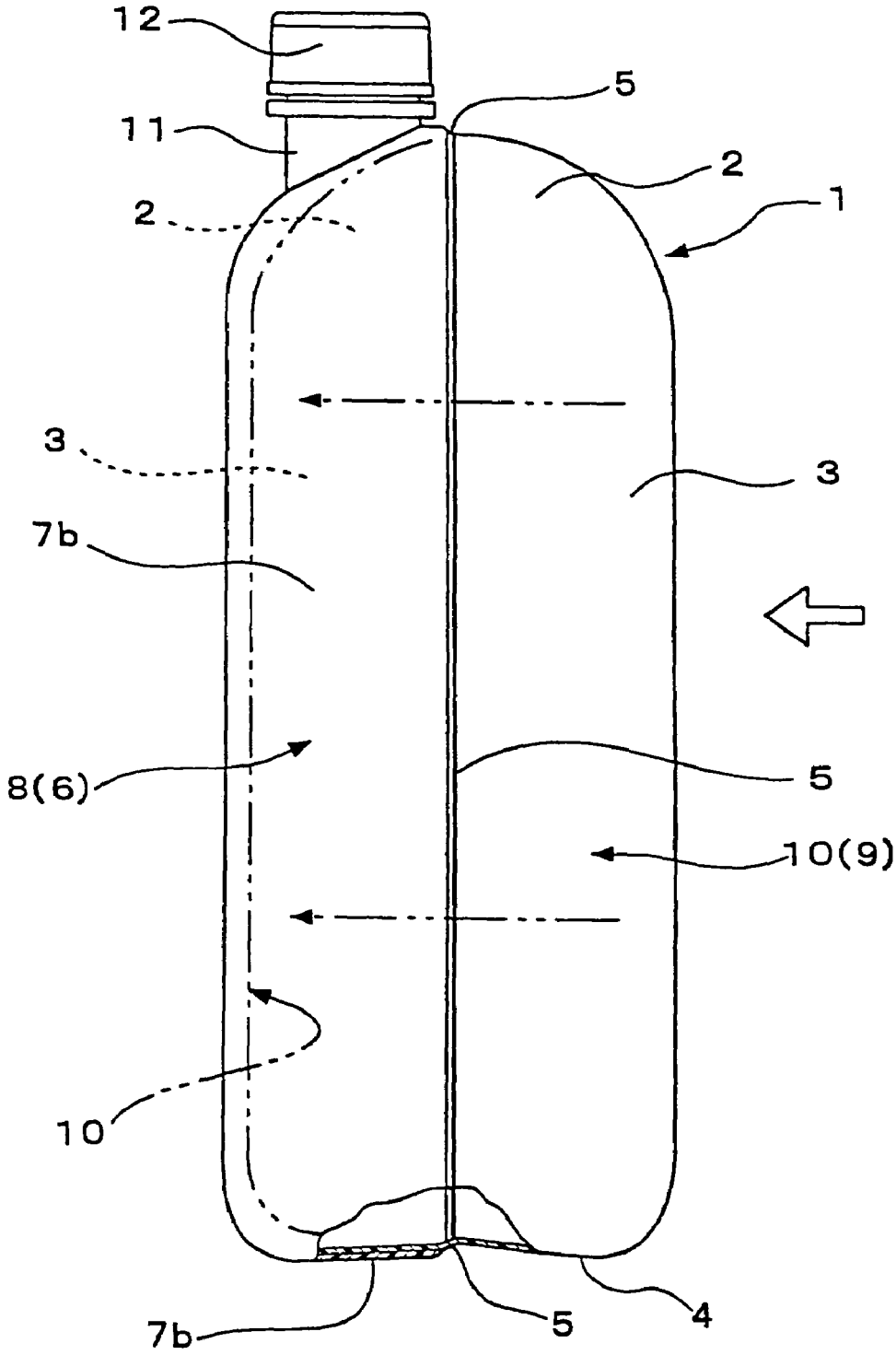
FIG. 6 is a partly cross-sectional side view showing a third exemplary embodiment.
Figure 7:
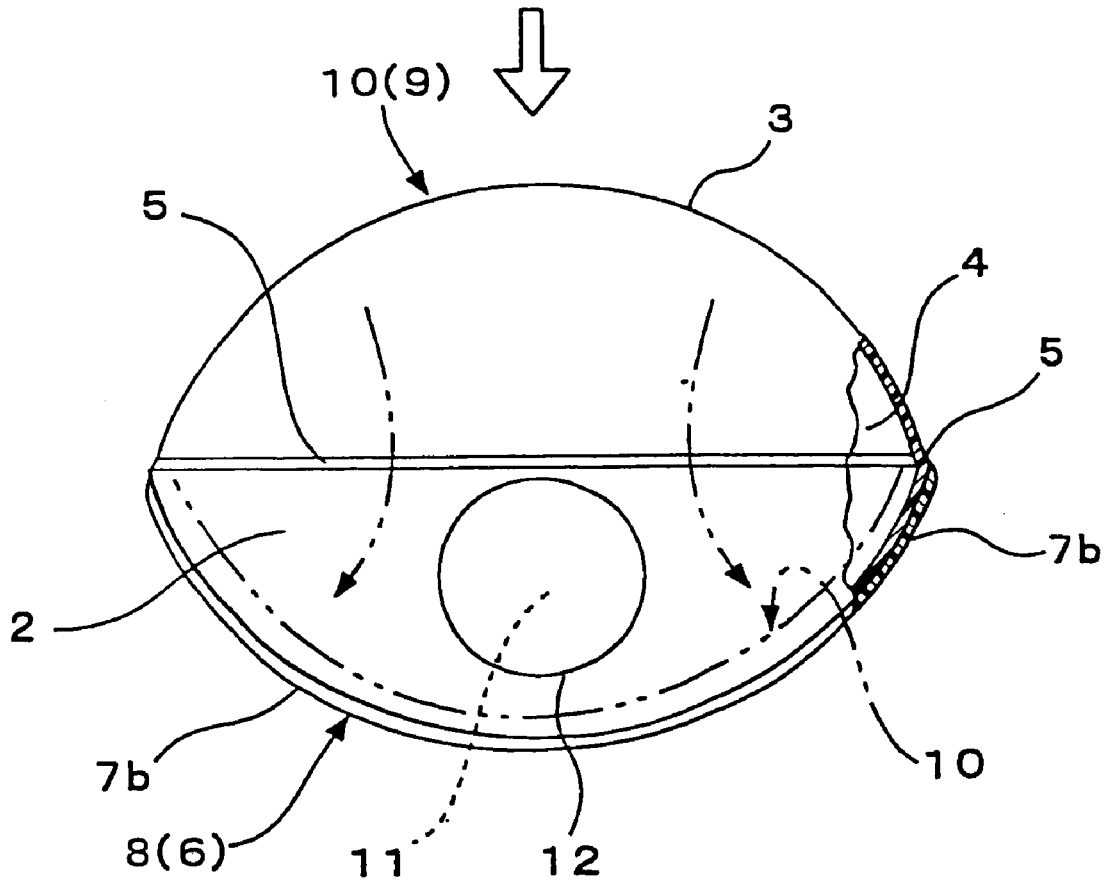
FIG. 7 is a partly cross-sectional plan view of the exemplary embodiment shown in FIG. 6.

FIGS. 6 and 7 show a synthetic resin bottle in the third embodiment of this invention. The overall shape of the bottle 1, the shape and position of the line of turn 5, and the like, are similar to those of the bottle in the first or second embodiment. The bottle 1 is molded by blow molding a relatively soft synthetic resin, such as low-density polyethylene, to have a thin wall thickness and to give the bottle 1 a roughly elliptic shape in its plan view.

Furthermore, the entire outer surface of the major-diameter portion 6 is laminated with an outer layer 7*b* by means of insert molding or co-extrusion. This outer layer 7*b* is made of a relatively hard synthetic resin material, such as high-density polyethylene, so that the major-diameter portion 6 can be sufficiently used as the shell section 8 having high rigidity.

Like the first and second embodiments, the reversible section 10 in the third embodiment is resiliently reversed simply by pressing it inward, and is entirely concaved into the inside of the shell section 8, as shown by a chain double-dashed line in FIGS. 6 and 7. The reversible section 10 can then be easily restored to its original shape by applying a force in the opposite direction and reversing this section outward.

Because of the lamination with a relatively hard synthetic resin material, such as high-density polyethylene, the shell section 8 has high rigidity and also a good buckling strength and the hardness enough to be able to grab the bottle. Therefore, the bottle can be held and handled in the same way as ordinary bottles. The bottle of this invention has no disadvantage of conventional volume-reducing bottles, which are too soft to hold the bottle firmly with a hand, and shows a stable "seating" function due to its high rigidity. If necessary, legs may be disposed under the bottom.

Figure 8:
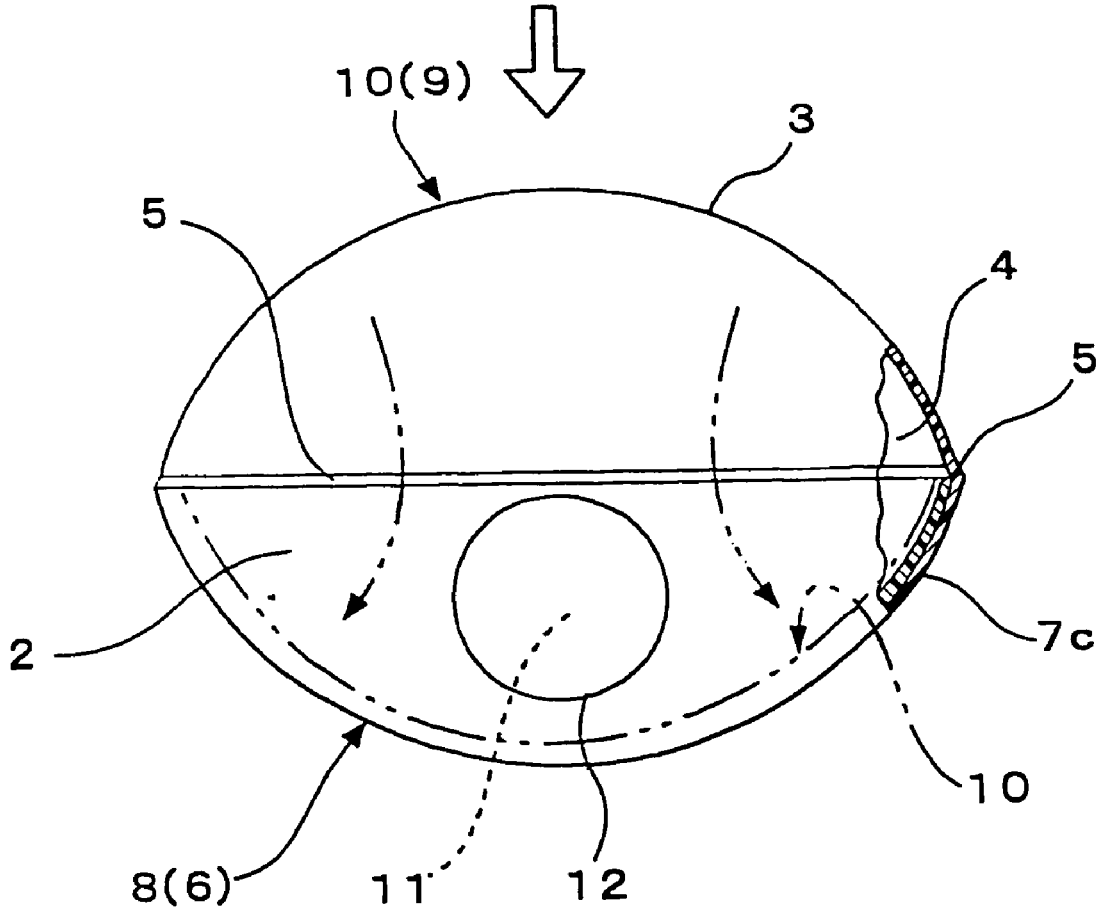
FIG. 8 is a partly broken, plan view showing a fourth exemplary embodiment.

FIG. 8 shows a synthetic resin bottle in the fourth embodiment of this invention. Unlike the third embodiment, in which the outer layer 7*b* is laminated to form the shell section 8, the fourth embodiment employs a means of co-extrusion, etc., to laminate an inner layer 7*c* over the entire inner surface of the major-diameter portion 6. This inner layer 7*c* is made of a relatively hard synthetic resin material, such as high-density polyethylene, and thus, the inner layer 7*c* turns the major-diameter portion 6 into the shell section 8 having high rigidity.

Figure 9:
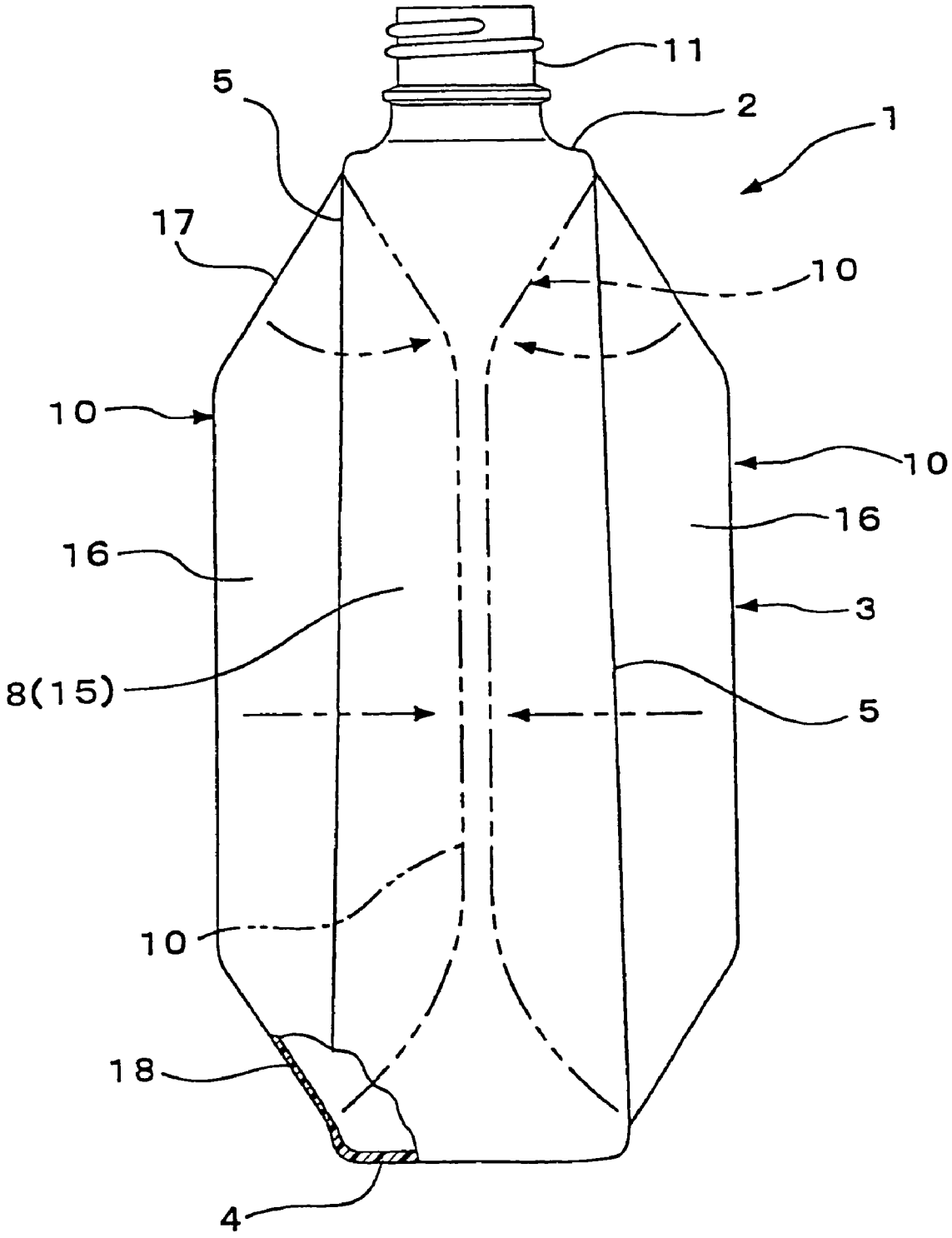
FIG. 9 is a partly broken, front elevational view showing a sixth exemplary embodiment.
Figure 10:
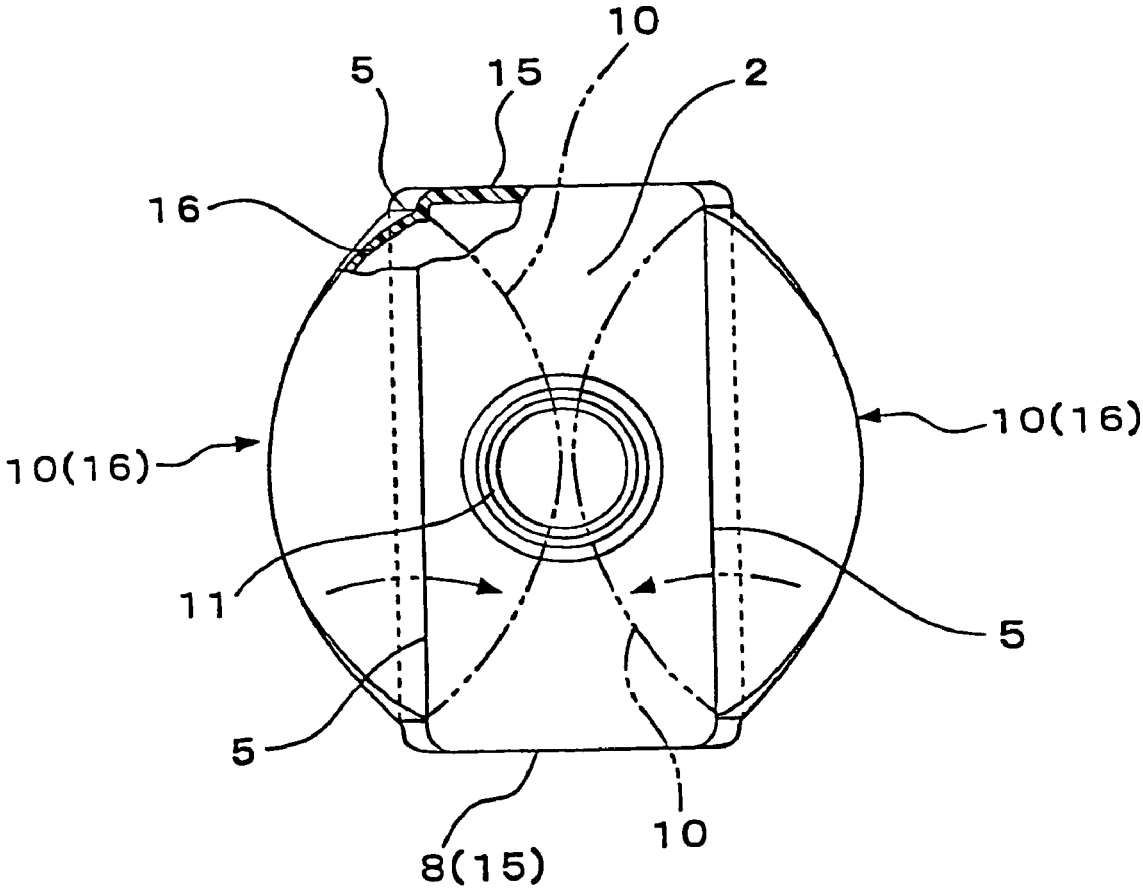
FIG. 10 is a partly broken plan view of the exemplary embodiment shown in FIG. 9.
Figure 11:
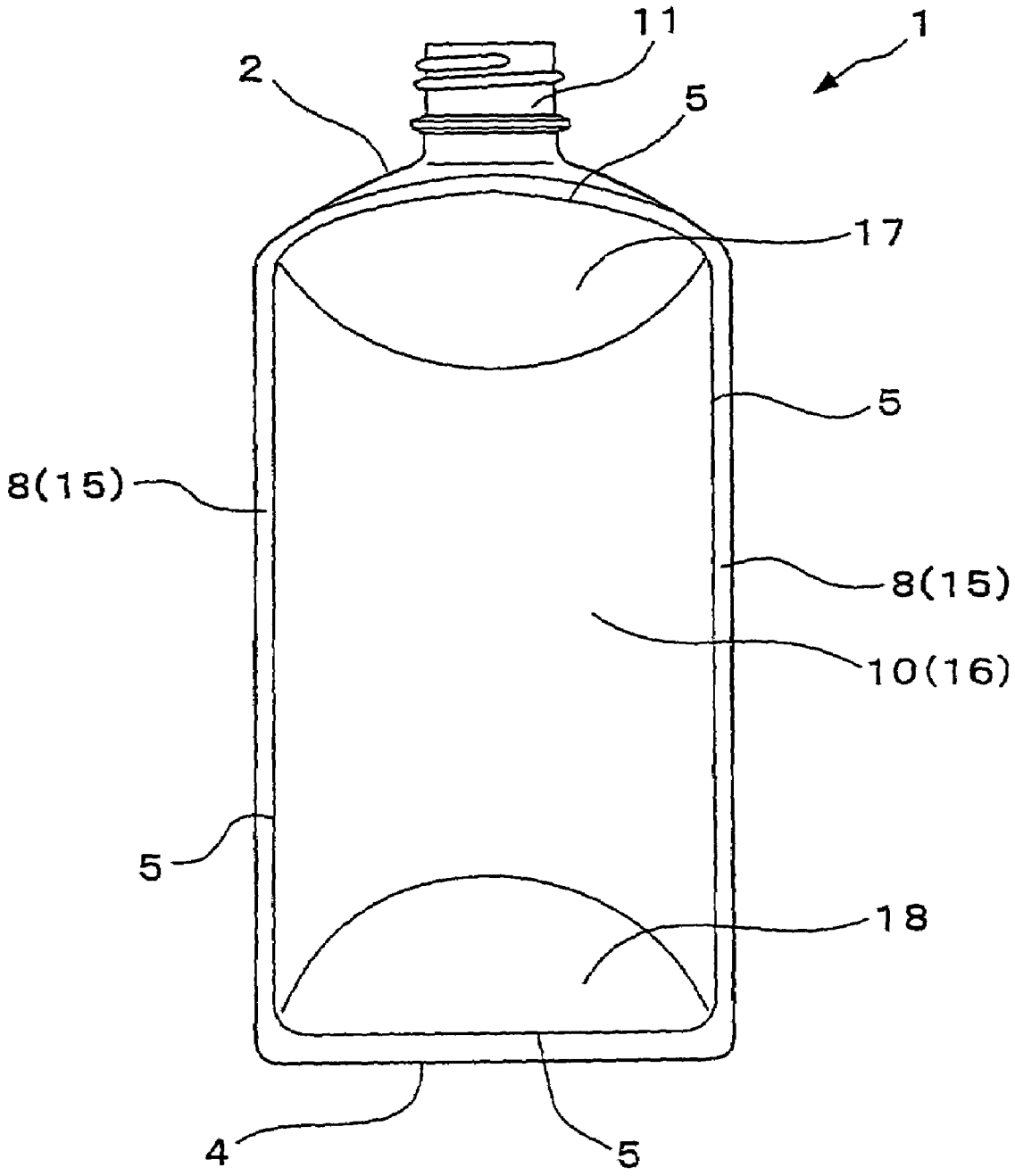
FIG. 11 is a side view of the embodiment shown in FIG. 9.

FIGS. 9–11 show a synthetic resin bottle in the sixth fifth embodiment of this invention. The bottle 1 of this embodiment is formed by blow molding a synthetic resin material, and comprises a pair of flat central walls 15 facing each other, a pair of hog-backed walls 16 having a nearly arc shape in the plan view and protruding right- and leftward from the central walls 15, and tapered walls 17 and 18 disposed at the upper and lower ends of each hog-backed wall 16.

The shoulder 2 allows the neck 11 to stand thereon, has a roughly rectangular shape on the plan view, and is disposed on the upper part of the body 3. The bottom 4 has also a roughly rectangular shape, and is disposed on the lower part of the body 3, as if the bottom 4 is an extension of the flat central wall 15 of the body 3. In the central frame, the bottle 1 has a configuration that, except for the neck 11, flat walls surround the central portion along the nearly entire vertical circumference.

The shoulder 2, the bottom 4, and the central walls 15 of the body 3 are molded to have an ordinary thick wall so that the shell section 8 with high rigidity is formed. A pair of right and left hog-backed walls is connected to the shoulder 2 and the bottom 4 through the tapered walls 17 and 18, respectively. Each hog-backed wall 16 protrudes outward for a maximum length corresponding to about a half of the central wall width, and has a relatively thin wall thickness. The tapered walls 17, 18 also have a thin wall thickness, and together with the hog-backed walls 16, constitute the reversible sections 10.

The lines of turn 5 in the shape of a shallow V groove for wall bending are formed on the surface along the border between the shell section 8 and both reversible sections 10.

When both reversible sections 10 are pressed inward, they are resiliently reversed from the respective lines of turn 5 and are concaved into the inside of the shell section 8 for volume reduction (See the chain two-dash line in FIGS. 9 and 10). The reversible sections 10 are easily restored to the original shape by applying an outward force in the opposite direction to reverse again these sections 10.

The reversible sections 10 of the bottle in this embodiment are concaved and stored inside of the central shell section 8 of a rectangular shape in its plan view, which includes the body 3 and the bottom 4. Therefore, it becomes possible for the bottle 1 to be fully concaved for volume reduction. As described above, the central shell section 8 has a configuration that flat walls surround the central portion along the nearly entire vertical circumference. Even in the volume-reduced state, the bottle 1 of this embodiment can fully stand on its own and has good handling ability.

In the fifth embodiment, the portion used as the shell section 8 and the portion or portions used as the reversible section or sections 10 are formed so as to have different wall thicknesses at the time of molding. However, even with these bottles, the entire bottle 1 can be molded to have a thin wall thickness. Then, a label is attached, or an outer or inner layer is laminated, to form the shell section 8, as distinguished from the reversible section or sections 10, as shown in the second, third, and fourth embodiments.

EFFECTS OF THE INVENTION

This invention having the foregoing configurations has the following effects.

In the exemplary embodiments, about a half each of the shoulder, the body, and the bottom on one side of the bottle molded by the container manufacturer can be concaved into the inside of the shell section, and the entire bottle can be fully flattened for volume reduction, by reversing the reversible section inward.

When bottles are handled in the fully flattened, volume-reduced state, the space of occupancy can be greatly decreased. This lowers the costs of storage and transportation, and makes bottle handling easy and efficient, during the processes followed until bottles are filled with liquid content.

After the reversible section has been restored to the original shape and the bottle has been used as a container, the reversible section is again concaved into the inside of the shell section, and the bottle is fully flattened, with volume reduced, and is put to waste disposal. Anyone should be able to fully flatten the bottle after use and dispose of the bottle as waste easily and efficiently.

In the exemplary embodiments, the reversible section protrudes in a semi-arc shape as seen in the plan view. This reversible section can be deformed and concaved into the inside of the shell section, which also protrudes in a semi-arc shape, but at a larger diameter than the reversible section. Since the entire bottle can be flattened in a certain shape, and since the flat bottles can be piled up, the storage and transportation of unused bottles and the disposal of used bottles can be efficiently carried out at a lower cost than usual.

In the exemplary embodiments, the neck is disposed on the shell section side. This makes it possible for the entire bottle to be flattened without crushing up the neck. Because of this configuration, it has become possible to deform and concave approximately a half of the entire bottle, including the shoulder, the body, and the bottom.

In the exemplary embodiments, the neck has also the shell section and the reversible section of its own. In such a configuration, it is possible to make the entire bottle sufficiently flat over all the height from neck to bottom.

In the exemplary embodiments, two lines of turn are provided, and the right and left reversible sections are concaved into the inside of the central shell section. Both reversible sections are concaved and stored in the inside of the central shell section of a rectangular shape in its plan view, which includes the bottom. Therefore, it becomes possible for the bottle to be fully concaved for volume reduction. Even in the volume-reduced state, the bottle can fully stand on its own and has good handling ability.

In the exemplary embodiments, the laminated bottle wall has higher rigidity than the non-laminated wall, namely, the wall portion of the bottle that has been molded to have usual thin walls. Since there is no need of changing the wall thickness of the bottle itself for both sections, bottles can be easily molded by an ordinary blow molding method while maintaining high productivity.

In the exemplary embodiments, a label attached to the outer surface of the body is used to form the shell section. In this case, the shell section can be formed easily and at a low cost. Furthermore, since a wide area can be secured for the label display, high decorative and display effects can be obtained.

In addition, the rigidity of the shell section is fully enhanced, and the bottle shows high shape-holding power. Because of these features, the bottle shape becomes stabilized and constant when the bottle is deformed for volume reduction and also when it is restored to the original shape. The bottle can be allowed to have thin walls with no difficulty, by making the label serve as a structural material.

In the exemplary embodiments, both of the shell section and the reversible section can be formed simultaneously at the time when the bottle is molded. Depending on the portions of the bottle, the ratio of wall thickness between the shell section and the reversible section can be changed to make fine adjustments to the rigidity of both sections. As a result, the reversible section can be concaved into the inside of the shell section and restored to the original shape quite easily.

In the exemplary embodiments, the line of turn comprises a sloped step. This line makes it quite easy to reverse and deform the reversible section, which can be smoothly concaved and then restored to its original shape. Since the reversible section is concavely reversed with no permanent deformation, there is no damage to the outer appearance caused by deformation.

In the exemplary embodiments, the line of turn comprises a shallow V-shaped groove. Because of this configuration, reversible sections can be easily and precisely reversed and deformed into and out of the shell section.

The invention claimed is:

1. A blow-molded synthetic resin bottle, comprising:

a shoulder;

a bottom;

a body located between the shoulder and the bottom; and at least one line of turn formed on the shoulder, the body, and the bottom along an entire vertical circumference of the bottle, and dividing the bottle into sections, the sections including:

at least one shell section located on one side of the line of turn, the shell section having a relatively high rigidity;

at least one reversible section located on another side of the line of turn, the reversible section having a relatively low rigidity such that the reversible section is deformable by resilient reversion; and a neck disposed only on a portion of the shoulder that is located on the one side of the line of turn in which the shell section is located, wherein the reversible section may be easily deformed from an original shape to a concave shape that may be received by the shell section and then restored back to the original shape by the resilient reversion, wherein the bottle is molded from a relatively soft synthetic resin so as to have a thin wall, and wherein a majority of at least one of an inner surface and an outer surface of the shell section is substantially laminated with another layer.

2. The blow-molded synthetic resin bottle according to claim 1, wherein the line of turn is disposed at a position that divides each of the shoulder, the body, and the bottom into two substantially equal, right and left parts, wherein the shell section comprises a major-diameter portion that is a half portion of the bottle located on the one side of the line of turn, and forms a first substantially arc-shaped convex surface with a first diameter, and wherein the reversible section comprises a minor-diameter portion that is another half portion of the bottle located on the other side of the line of turn, and forms a second substantially arc-shaped convex surface with a second external diameter smaller than the first diameter.

3. The blow-molded synthetic resin bottle according to claim 1, wherein the line of turn comprises a pair of lines of turn formed at substantially symmetrical positions on the shoulder, the body, and the bottom to divide the bottle into the sections, and wherein the shell section comprises a central portion of the bottle where side walls of the body face each other, and the reversible section comprises two reversible sections disposed on opposing sides of the shell section, each of the reversible sections including an arc-shaped convex surface that protrudes outwards for a length equal to about half of the side wall width of the shell section.

4. The blow-molded synthetic resin bottle according to claim 1, wherein a relatively thick, hard label is laminated over an outer surface of the bottle.

5. The blow-molded synthetic resin bottle according to claim 1, wherein the shell section is molded to include a relatively thick wall, and the reversible section is molded to have a relatively thin wall.

6. The blow-molded synthetic resin bottle according to claim 1, wherein the line of turn comprises a sloped step.

7. The synthetic resin bottle according to claim 1, wherein the line of turn comprises a shallow V-shape groove.

* * * * *